United States Patent [19]

Kataoka et al.

[11] Patent Number: 4,857,920

[45] Date of Patent: Aug. 15, 1989

[54] COMBINED TRAFFIC SIGNAL WITH STACKED EL ELEMENTS

[75] Inventors: Shoei Kataoka, Tokyo; Masaru Yoshida; Shigeo Nakajima, both of Nara, all of Japan

[73] Assignee: Sharp Kabushiki Kaisha, Osaka, Japan

[21] Appl. No.: 106,545

[22] Filed: Oct. 6, 1987

[30] Foreign Application Priority Data

Oct. 7, 1986 [JP] Japan ..... 61-239627

[51] Int. Cl.[4] ..... G08G 1/095

[52] U.S. Cl. ..... 340/907; 313/506; 313/509; 313/510

[58] Field of Search ..... 340/907, 84, 781, 716, 340/717, 107, 815.32, 944; 358/59; 313/506, 509, 510; 40/544

[56] References Cited

U.S. PATENT DOCUMENTS

| | | | |
|---|---|---|---|
| 2,867,739 | 1/1959 | Michlin | 340/781 X |
| 3,680,237 | 8/1972 | Finnerty, Sr. | 40/544 |
| 3,870,991 | 3/1975 | Hayes | 340/907 |
| 4,568,928 | 2/1986 | Biferno | 340/716 |
| 4,666,793 | 5/1987 | Hirate | 313/509 X |
| 4,719,385 | 1/1988 | Barrow et al. | 340/781 X |

*Primary Examiner*—Joseph A. Orsino
*Assistant Examiner*—Brian R. Tumm
*Attorney, Agent, or Firm*—Flehr, Hohbach, Test, Albritton & Herbert

[57] ABSTRACT

A highly reliable and economical traffic signal has only one light-emitting display section having two or more semiconductor thin-film EL plates of different colors such as green and red stacked one on top of the other. Green and red can be displayed by causing one of the EL plates to emit light and yellow can be displayed by causing both of them to emit light.

13 Claims, 3 Drawing Sheets

COMBINED TRAFFIC SIGNAL WITH STACKED EL ELEMENTS

BACKGROUND OF THE INVENTION

This invention relates to a traffic signal which makes use of transparent semiconductor elements in its light-emitting display section.

Conventional traffic signals make use of lamps of an ordinary type having a filament as the source of light. To display green for "safe", red for "danger" and yellow for "warning", transparent colored members such as tinted glass pieces are placed in front of individual lamps which are turned on one at a time. In other words, a conventional traffic signal contains two or three independent lamps disposed next to each other as shown in FIG. 6.

With a conventional traffic signal, filaments of its lamps cannot be prevented from breaking suddenly. For this reason, signal lamps are replaced regularly by new ones at a fixed interval, such as once a year. The cost and labor involved in this process are enormous. Another disadvantage of these conventional traffic signals is that the colored glass surfaces reflect light when a strong beam of light is directly incident thereon. When this happens, it is often impossible to tell which of the signal lamps is lit and this may cause a serious traffic accident. Still another disadvantage of these filament lamps is that their energy efficiency is low and hence that their rate of power consumption is high. Moreover, the light-emitting surface of a filament lamp is very small compared to the area of display such that it is nearly a point light source. Although a beam expander is used to expand the beam uniformly, it is difficult to achieve a completely uniform distribution in brightness.

Japanese Patent Publication No. 59-194286, for example, has disclosed a traffic signal making use of an arrangement of a large number of light-emitting diodes adapted to emit light of different colors, to display green, red, and yellow. Even with light-emitting diodes, however, three display sections corresponding to three different colors are necessary and the signal cannot be made smaller. Besides, it is both cumbersome and time-consuming to arrange thousands of light-emitting diodes in a plane.

SUMMARY OF THE INVENTION

It is therefore an object of the present invention to eliminate the disadvantages of conventional traffic signals by providing an improved traffic signal of a new kind which uses a light-emitting surface device based on a new principle and is substantially superior to conventional signals regarding reliability, capabilities and productivity.

The above and other objects of the present invention are achieved by providing a traffic signal having at its light-emitting display section at least two transparent electroluminescent (EL) elements of different colors disposed overlappingly with respect to each other, such that either one alone or both of them can be made to emit light by selectively applying a voltage thereto and that either of the colors or a combination of these colors can be displayed in the display section.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
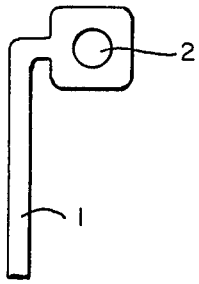
FIG. 1 is an external view of a traffic signal embodying the present invention.
Figure 2:
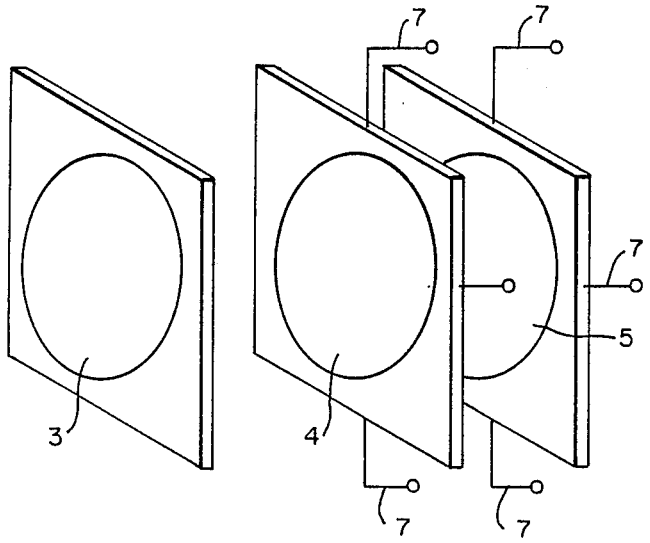
FIG. 2 is an exploded view of a part of the traffic signal of FIG. 1.
Figure 3A:
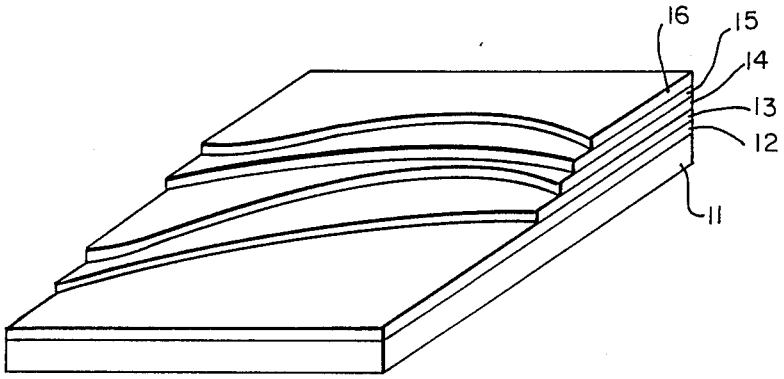
FIG. 3A is a diagonal broken-up view of a thin-film red or green EL plate and FIG. 3B is its sectional view.
Figure 3B:
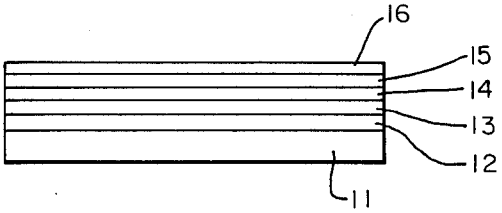

With reference to FIG. 1, a traffic signal 1 of the present invention is characterized as having only one light-emitting display section 2 adapted to display green, yellow and red selectively. The light emitting display section 2 is comprised, as shown in FIG. 2, of a protective transparent plate 3, a red thin-film EL plate 4 and a green thin-film EL plate 5. The red thin-film EL plate 4 is formed, as shown in FIGS. 3A and 3B, by stacking a transparent electrode film 12, an insulating film 13, a light-emitting layer 14, another insulating film 15 and another transparent electrode film 16, in this order, on top of a glass substrate 11. The green thin-film EL plate 5 is formed similarly, as shown for convenience also in FIGS. 3A and 3B, by stacking a transparent electrode film 12', an insulating film 13', a light-emitting layer 14', another insulating film 15' and another transparent electrode film 16', in this order on top of a glass substrate 11'. In order to eliminate the problems of broken wires, defective insulation, etc., lead lines 7 are provided to the transparent electrode films 12 and 16 at several positions at equal intervals such that a plurality of wires serve to connect these electrodes to a power source (not shown). When emission of light at a high brightness level is desired, the power source for the thin-film EL plates 4 and 5 is formed with a transister voltage-generating circuit and a voltage of 1 KHz-180 V is applied. If the level of brightness may be somewhat reduced, the applied voltage is 1 KHz-100 V.

Figure 7A:
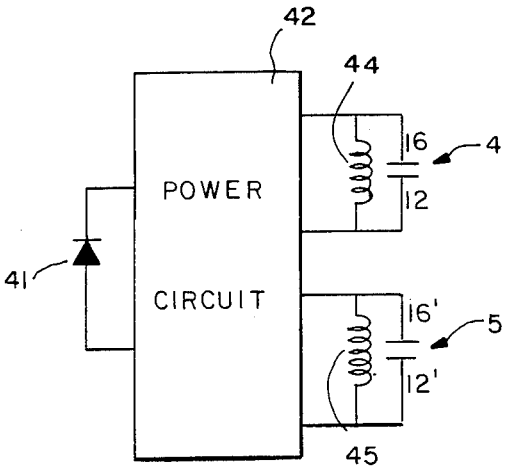
FIGS. 7A and 7B are circuit diagrams of circuits for lighting a thin-film EL plate shown in FIGS. 2 and 4, respectively.

A circuit for driving the thin-film EL plates 4 and 5 as shown in FIG. 2 is shown in FIG. 7A. In order to vary the intensity of their light emission according to the brightness of their environment, its power circuit 42 is controlled by the output of a light-receiving element 41 such that the light from the thin-film EL plates 4 and 5 is bright during the day and not so bright at night. In order to improve the power efficiency of the power circuit 42, a coil 44 is connected in parallel with the thin-film EL plates 4 and 5 and its inductance is so adjusted with respect to the capacitance of the thin-film EL plates 4 and 5 that the resonance frequency determined by them matches the frequency of the power source.

Regarding the red and green thin-film EL plates 4 and 5, the thin-film transparent electrode films 12 and 16 and the insulating films 13 and 15 are nearly of the same materials and produced by the same methods, but the material and the production method of the light-emitting layer 14 is different, depending on the color of emitted light. The light-emitting layer of the red EL plate 4 may be formed by adding Eu to GaS or from a film having Mn-F light-emitting centers formed by adding a rare earth chloride and Mn to ZnS. The light-emitting layer of the green EL plate 5 may be formed by adding $TbF_3$ to ZnS. Japanese Patent Applications 60-10074 and 60-116071 filed by the present assignee describe red and green thin-film EL elements, respectively.

Figure 4:
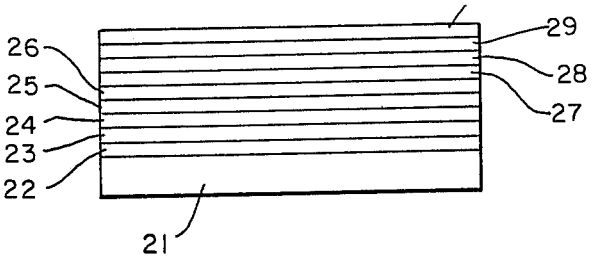
FIG. 4 is a sectional view of another thin-film EL plate.
Figure 7B:
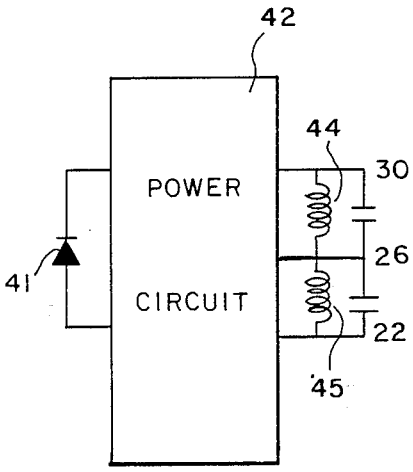

According to the examples described above by way of FIGS. 2 and 3, the red and green EL plates 4 and 5 are stacked one on top of the other, but this is not intended to limit the scope of the present invention. FIG. 4 shows the structure of another light-emitting display section embodying the present invention characterized as having a green EL element and a red EL element stacked together on a single glass substrate. In FIG. 4, numeral 21 indicates a glass substrate, numeral 24 indicates a green light-emitting layer, numeral 28 indicates a red light-emitting layer, numerals 22, 26 and 30 indicate transparent electrode films and numerals 23, 25, 27 and 29 indicate insulating films. A circuit for driving this display section shown in FIG. 4 is shown in FIG. 7B wherein components which are substantially identical and/or function substantially identically to those shown in FIG. 7A are indicated by the same numerals. With the light-emitting section thus structured with the red and green EL elements stacked one on top of the other, red is displayed if an AC voltage is applied between the transparent electrodes sandwiching the red light-emitting layer, green is displayed if an AC voltage is applied between the transparent electrodes sandwiching the green-emitting layer and yellow is displayed as a mixture of red and green if an AC voltage is applied simultaneously to the red and green light-emitting layers such that both red and green light beams are emitted.

Figure 5A:
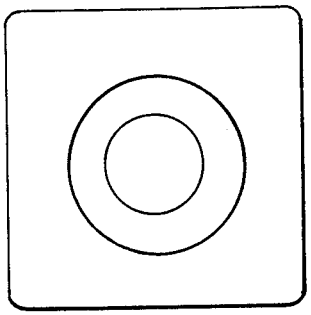
FIGS. 5A–5G are views of other light-emitting display sections embodying the present invention.
Figure 5B:
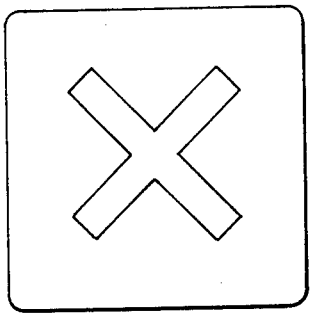
Figure 5C:
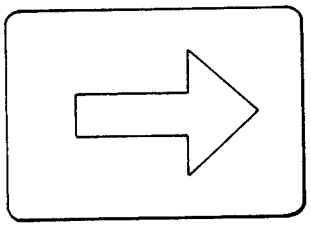
Figure 5D:
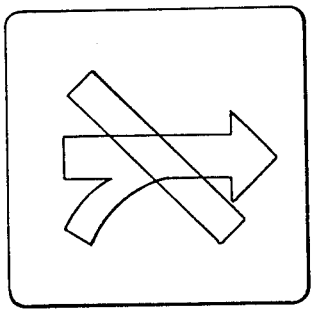
Figure 5E:
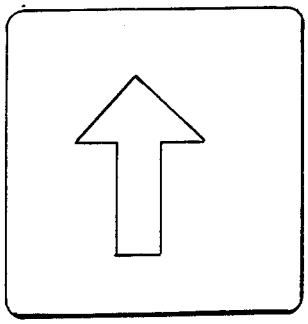
Figure 5F:
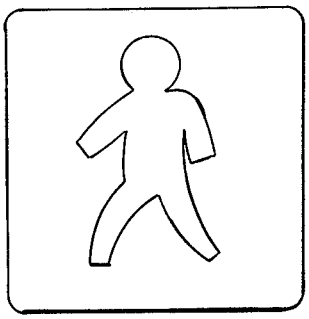
Figure 5G:
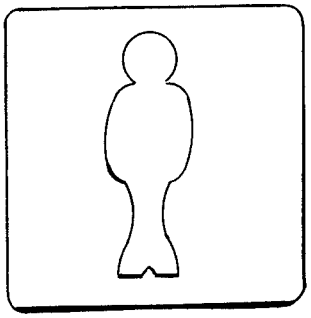
Figure 6:
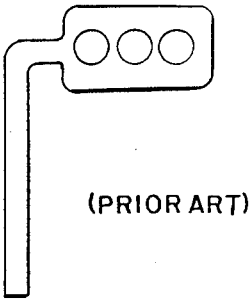
FIG. 6 is an external view of a conventional traffic signal.

Various patterns of light-emitting layers or transparent electrode films for the EL plates of the present invention are shown in FIGS. 5A–5G. FIG. 5A is an example of a signal lamp comprised of a green thin-film EL plate to display a green circle to show a safe condition. FIG. 5B is an example of a signal lamp comprised of a red thin-film EL plate to display a red X to show a dangerous condition. FIGS. 5C and 5E use a green EL plate to display an arrow to indicate an allowed direction of motion. FIG. 5D is an example composed of a green EL plate in the shape of an arrow and a red EL plate in the form of a diagonal line whereby a "go" signal in the direction of the arrow and a "stop" signal can be alternately displayed. FIG. 5F is an example with a green EL plate for displaying a walking pedestrian and FIG. 5G is an example with a red EL plate for displaying a waiting pedestrian. The patterns of FIGS. 5A and 5B and those of FIGS. 5F and 5G may be superposed one on top of the other. In summary, a traffic signal embodying the present invention uses a light-emitting surface device and, having only one light-emitting display section, can be made to emit red, green and yellow light selectively by controlling the voltage application. Since there is only one light-emitting display section, the signal can be made small in size. Its thin-film EL plates emit light in response to an applied electric field and even if a defect is developed locally in a transparent electrode film 12 or 16, an insulating film 13 or 15, or the light-emitting layer 14, such a local defect rarely spreads. Unlike the conventional filament lamp, the EL plates do not suddenly stop working. Thin-film EL plates are known to operate for more than 10,000 hours without incurring any change in brightness and its brightness changes only gradually. In other words, traffic signals using such plates as a source of light are more reliable than conventional signals using ordinary filament lamps. Furthermore, the lamps of the present invention need not be replaced as frequently as the conventional lamps and a significant economical advantage can be achieved. Another advantage of the present invention is the improved efficiency of emission of light such that power consumption can be reduced. Still another advantage relates to improved visibility of the signal because light is emitted more uniformly from the surface and the quality of the display does not depend on the angle from which it is seen.

The foregoing description of preferred embodiments of the invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included to be within the scope of this invention.

What is claimed is:

1. A traffic signal comprising a display section having at least two transparent EL elements for emitting light of different colors including red, said EL elements being stacked one on top of each other on top of a glass substrate at said display section, either one or both of said EL elements being adapted to emit light in response to a voltage applied on said one or both of said EL elements to display in said display section either of said different colors or a combination of said different colors, said traffic signal further comprising a transparent internal electrode film sandwiched between said EL elements.

2. The traffic signal of claim 1 wherein said voltage is applied by a driving circuit including a power circuit connected to said EL elements, a coil connected in parallel with said EL elements to said power circuit and a light-receiving diode adapted to control said power circuit according to the brightness of light received by said light-receiving diode.

3. A traffic signal comprising a display section having at least two transparent EL elements for emitting light of different colors including red, said EL elements being stacked one on top of each other on top of a glass substrate at said display section, either one or both of said EL elements being adapted to emit light in response to a voltage applied on said one or both of said EL elements to display in said display section either of said different colors or a combination of said different colors, each of said EL elements including a light-emitting layer sandwiched between an insulating film and an external electrode.

4. A traffic signal comprising a display section having at least two transparent EL elements for emitting light of different colors, said EL elements being stacked one on top of each other on top of a glass substrate at said display section, either one or both of said EL elements being adapted to emit light in response to a voltage applied on said one or both of said EL elements to display in said display section either of said different colors or a combination of said different colors, said EL elements having a transparent internal electrode film sandwiched therebetween.

5. The traffic signal of claim 4 wherein said voltage is applied by a driving circuit including a power circuit connected to said EL elements, a coil connected in parallel with said EL elements to said power circuit and a light-receiving diode adapted to control said power circuit according to the brightness of light received by said light-receiving diode.

6. A traffic signal comprising a display section having at least two transparent EL elements for emitting light of different colors including red, said EL elements being stacked one on top of each other on top of a glass substrate at said display section, either one or both of said EL elements being adapted to emit light in response to a voltage applied on said one or both of said EL elements to display in said display section either of said different colors or a combination of said different colors, said voltage being applied by a driving circuit which includes a power circuit connected to said EL elements, a coil connected in parallel with said EL elements to said power circuit and a light-receiving diode adapted to control said power circuit according to the brightness of light received by said light-receiving diode.

7. A traffic signal comprising a display section having at least two transparent EL elements for emitting light of different colors, said EL elements being stacked together at said display section, either one or both of said EL elements being adapted to emit light in response to a voltage applied on said one or both of said EL elements to display in said display section either of said different colors or a combination of said different colors, said EL elements being shaped so as to represent a colored symbol indicative of a safe or dangerous traffic condition or a traffic command.

8. The traffic signal of claim 7 wherein said voltage is applied by a driving circuit including a power circuit connected to said EL elements, a coil connected in parallel with said EL elements to said power circuit and a light-receiving diode adapted to control said power circuit according to the brightness of light received by said light-receiving diode.

9. The traffic signal of claim 7 wherein each of said transparent EL elements includes a combination of a light-emitting layer, insulating films sandwiching said light-emitting layer and transparent electrode films, said combination being disposed above a glass substrate.

10. The traffic signal of claim 7 wherein said EL elements are stacked one on top of each other on top of a glass substrate.

11. The traffic signal of claim 10 wherein said EL elements include a red-light emitting EL element and a green-light emitting EL element.

12. The traffic signal of claim 10 further comprising a transparent internal electrode film sandwiched between said EL elements.

13. The traffic signal of claim 10 wherein each of said EL elements includes a light-emitting layer, an insulating film and an external electrode.

* * * * *